US007578491B2

(12) United States Patent
Axel

(10) Patent No.: US 7,578,491 B2
(45) Date of Patent: Aug. 25, 2009

(54) DEVICE FOR RECORDING NOTATIONS AND RELATED METHOD

(76) Inventor: Raymond Axel, 361 Merrill Ave., Calumet City, IL (US) 60409

( * ) Notice: Subject to any disclaimer, the term of this patent is extended or adjusted under 35 U.S.C. 154(b) by 0 days.

(21) Appl. No.: 12/018,311

(22) Filed: Jan. 23, 2008

(65) Prior Publication Data

US 2008/0111045 A1 May 15, 2008

Related U.S. Application Data

(62) Division of application No. 11/222,582, filed on Sep. 9, 2005.

(60) Provisional application No. 60/608,506, filed on Sep. 9, 2004.

(51) Int. Cl.
*A47B 97/04* (2006.01)

(52) U.S. Cl. ..... 248/444; 248/454

(58) Field of Classification Search ..... 248/444, 248/447

See application file for complete search history.

(56) References Cited

U.S. PATENT DOCUMENTS 1,893,976 A 1/1933 Anderson
2,263,154 A 11/1941 Witting
2,627,139 A 2/1953 Davidson
2,701,173 A 2/1955 Senior et al.
2,861,854 A 11/1958 Best
2,876,022 A 3/1959 Kroviak
2,996,830 A 8/1961 Reichmuth
3,106,037 A 10/1963 Harkey
3,463,438 A 8/1969 Olson
3,991,966 A 11/1976 Breer, II
4,466,638 A 8/1984 Miskin
4,568,052 A 2/1986 Solomon et al.
4,987,690 A 1/1991 Aaldenberg et al.
4,998,185 A 3/1991 DeNigris, Jr.
5,292,099 A 3/1994 Isham et al.
5,823,500 A 10/1998 La Coste
6,106,016 A 8/2000 Bette
2004/0188588 A1 9/2004 Smith
2004/0234939 A1 11/2004 Smith et al.
2005/0183298 A1 8/2005 Cohen et al.
2006/0060746 A1 3/2006 Hsu

*Primary Examiner*—J. Allen Shriver, II
*Assistant Examiner*—Bradley H Duckworth
(74) *Attorney, Agent, or Firm*—Leydig, Voit & Mayer, Ltd.

(57) ABSTRACT

Device and related method for supporting a writing surface adapted to receive written information, the device comprising a base portion comprising a substantially planar surface which includes a writing surface and a clip portion attached to the base portion for securing the device onto a substrate, wherein the base and clip portions are angled relative to one another in a range of from about 0° to about 180°.

12 Claims, 16 Drawing Sheets

DEVICE FOR RECORDING NOTATIONS AND RELATED METHOD

CROSS-REFERENCE TO RELATED APPLICATIONS

This patent application claims the benefit of U.S. Provisional Patent Application No. 60/608,506, filed Sep. 9, 2004, which is incorporated by reference.

FIELD OF THE INVENTION

The present invention relates to devices that assist a person in recording information for future reference and related methods of use.

BACKGROUND OF THE INVENTION

Various professions require information to be recorded for future reference. Craftsmen, such as carpenters, plumbers and electricians, require physical dimensions of wood, pipe and the like to be recorded, while salespeople often need to record telephone numbers or orders.

Often, and particularly at construction sites, there is an absence of suitable material onto which information can be recorded. Without this material, important information can be forgotten, leading to inefficiencies.

Thus, a need exists for a device and related method suitable for assisting a person in recording information so that the information can be subsequently retrieved, wherein the device is inexpensive, easy to use, and does not interfere with normal activity, particularly when used by a craftsman while working.

SUMMARY OF THE INVENTION

In one aspect, the present invention provides a device for supporting a writing surface adapted to receive written information comprising a base portion comprising a substantially planar surface which includes a writing surface and a clip portion attached to the base portion for securing the device onto a substrate, wherein the base and clip portions are angled relative to one another in a range of from about 0° to about 180°.

In a related aspect, the present invention provides a method for recording information by a person wearing an article of clothing comprising providing a base portion comprising a substantially planar surface which includes a writing surface and a clip portion attached to the base portion for securing the device onto a substrate, wherein the base and clip portions are angled relative to one another in a range of from about 0° to about 180°, attaching the device onto the article of clothing, and recording information on the writing surface.

These and other aspects of the present invention are described in more detail herein which set forth various preferred embodiments of the invention.

DESCRIPTION OF THE PREFERRED EMBODIMENTS

In one aspect, the present invention provides a device which enables a user to record information in writing thereon.

Figure 1:
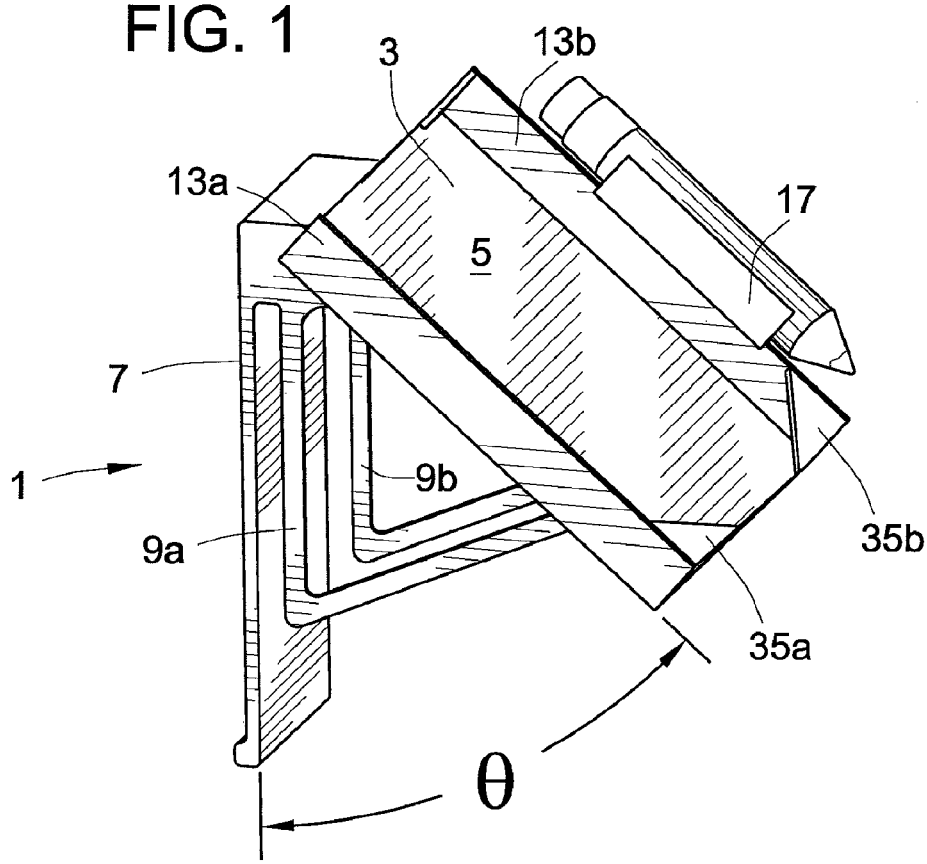
FIG. 1 is a perspective view of a first embodiment of the device contemplated by the present invention.

Turing initially to FIG. 1, there is depicted therein a first embodiment of the present invention. This embodiment 1 comprises a base portion 3 which in turn comprises a substantially planar writing surface 5 and a clip portion 7 attached to the base portion for attaching the device onto a substrate. The base 3 and clip 7 portions in this embodiment are desirably angled relative to one another from about 0° to about 110°; preferably between about 0° and about 90°, more preferably between about 0° and about 60°, and most preferably between about 0° and about 45°. Preferred embodiments may include base portions angled relative to clip portions at about, for example, 0°, 15°, 30°, 45°, 60°, 75°, 90° or 110°. The angle between the base 3 and clip 7 is designated in the figures as θ.

The writing surface 5 depicted in this embodiment, which also may be incorporated into the other embodiments described herein, desirably comprises an erasable surface on which information may be recorded. Various erasable surfaces suitable for use in the embodiments described herein, and erasable markers suitable for use thereon (often referred to as dry erase markers), are well known and as such will not be described in further detail.

Figure 2:
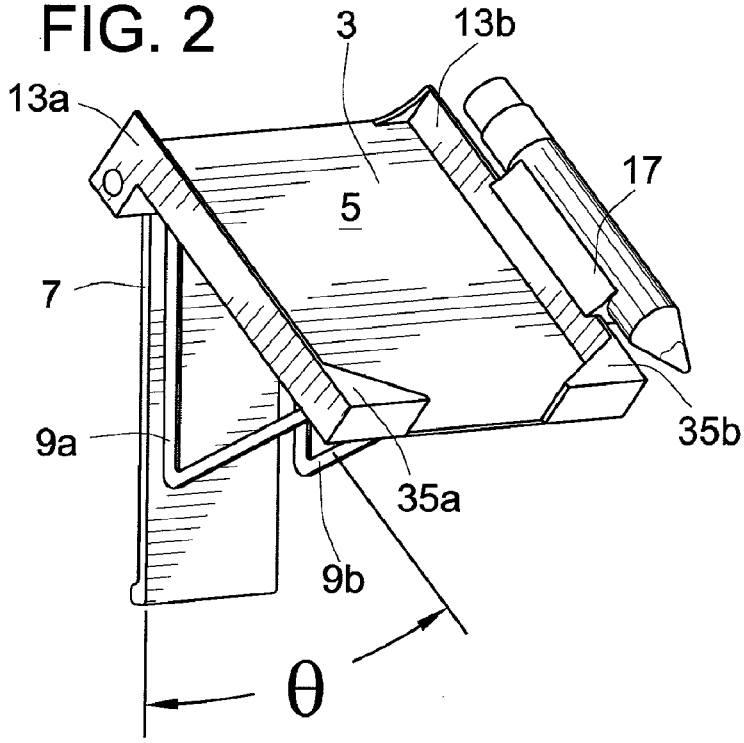
FIG. 2 is a perspective view of a second embodiment of the device contemplated by the present invention.

The embodiment of FIGS. 1 and 2, as well as other embodiments and figures included herein, further desirably include a support 9 located between the base and clip portions. This support assists in maintaining the angled relationship between the base and clip portions when pressure is applied onto the writing surface 5. Although illustrated in FIGS. 1 and 2 (as well as in certain other figures) as unhinged stationary support dual members (9*a*, 9*b*) which are relatively thin in cross-section (about ⅛ to about ¾ inch) and located at the periphery of the base and clip portions, the support may comprise one, two or more members. These members may be attached to the base and/or support at one or both ends.

Figure 11:
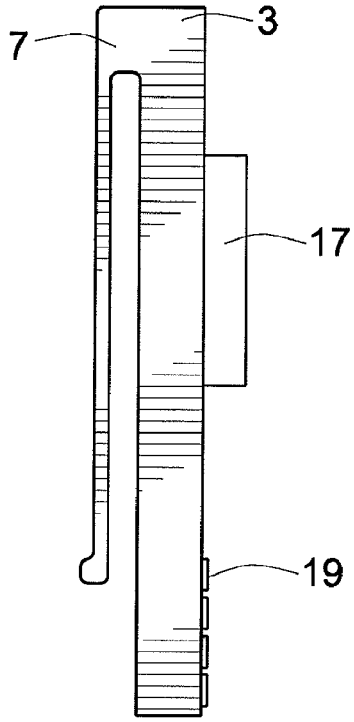
FIG. 11 is a side view of the device depicted in FIG. 10.
Figure 12:
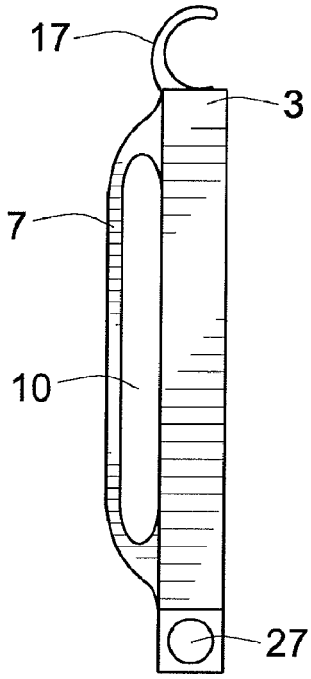
FIG. 12 is a side view of an eighth embodiment of the device contemplated by the present invention.
Figure 13:
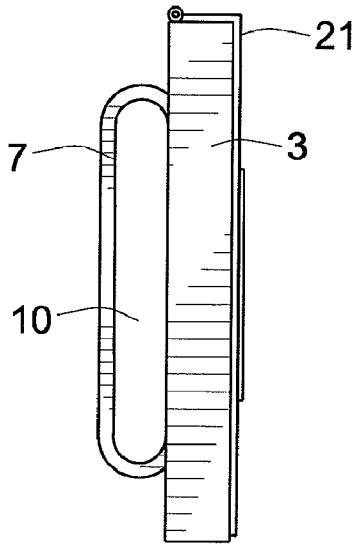
FIG. 13 is a side view of a ninth embodiment of the device contemplated by the present invention.
Figure 21:
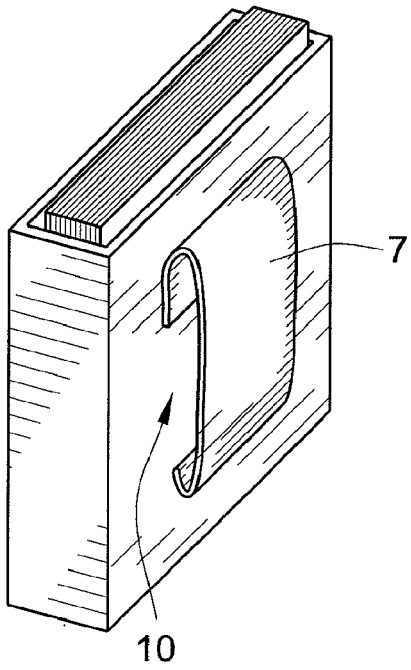
FIG. 21 is a perspective view of a sixteenth embodiment of the device contemplated by the present invention.

The clip portion 7, in this as well as in the other embodiments illustrated in the figures, comprises, in one aspect, a substantially flat piece of material that may be attached to the base at one end of the base as depicted in FIGS. 1-11, 14-20, 22, 23*a*, 23*b*, 24, 25, 26*a*, 26*b* and 27, or at both ends of the base, as depicted in FIGS. 12, 13 and 21. When attached at a single end of the base, the clip preferably provides an inverted U-shape, having an open end (e.g., indicia 8*b* in FIGS. 16 and 17) and a closed end (e.g., indicia 8*a* in FIGS. 16 and 17) to permit attachment of the device onto a substrate, such as an article of clothing worn by the user. Exemplary substrates onto which the device may be secured include, but are not limited to, shirt pockets, trouser pockets and waistlines, trouser belts, carpenter's aprons, and tool belts. The clip may provide this U-shape either alone, as exemplified in FIG. 16, in combination with a support (exemplified as structures 9*a* and 9*b* in FIG. 1) located between the base and clip portion, or in combination with the base, e.g., FIGS. 9 and 11 When the clip portion is attached to the base at both ends (e.g., FIGS. 12, 13 and 21), the clip portion provides an opening 10 through which a means of carrying the device may be passed. Exemplary substrates onto which the device having this type of clip portion may be secured include a trouser belt or tool belt.

Any type of clip, made of any material, may be used so long as the device is sufficiently secure to permit the recording of information therein by a person using a writing implement, e.g., pencil, pen, marker (such as for example, a Sharpie®, or dry erase marker). Metal clips are preferred, but clips prepared from polymer materials may also be used. A clip made of a polymeric material that is integrally molded with the base, as exemplified in FIGS. 9, 12, 13 and 27, is preferred.

Figure 16:
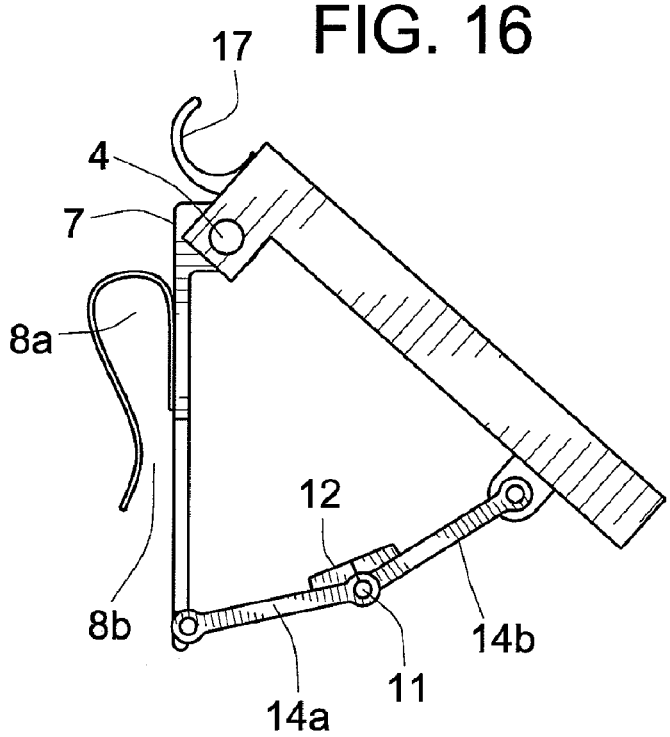
FIG. 16 is a side view of an eleventh embodiment of the device contemplated by the present invention wherein a hinged support is depicted in a fully extended position.
Figure 17:
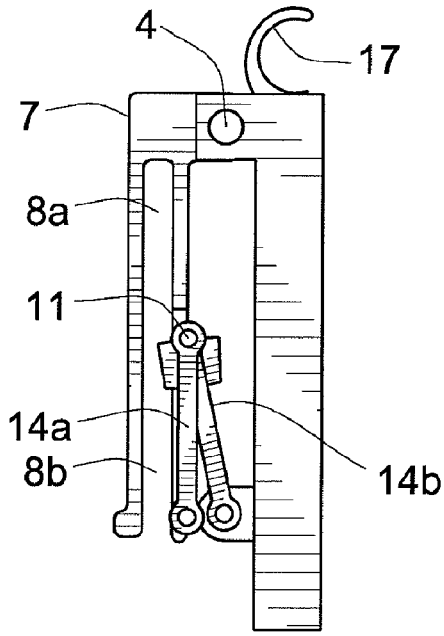
FIG. 17 is a side view of a twelfth embodiment of the device contemplated by the present invention.

Desirably, and as exemplified in FIGS. 5-7, 14, 16, 17, 24, 25 26*a* and 26*b*, the base and clip portions pivot relative to one another along a hinge 4, with a hinged support 14*a*, 14*b* preferably further including a locking mechanism 11 (FIGS. 16 and 17).

The various embodiments that permit the base and clip portions to pivot permit the angle (θ) between the base and clip portions to be adjustable between first and second positions, ranging between about 0° and about 180°. The first position (fully retracted) would be desirable when the device was not in use, to reduce interference with a user's activity, with the second position (extended) being desirable when use of the device is contemplated by the user. When extended, the angle θ would depend on the length of the stationary 9*a*, 9*b* or hinged 14*a*, 14*b* supports. For example, the angle θ between the clip and base portions may range from about 15° and 90°, from about 30° and about 90°, from about 45° and 90°, or be about 15°, 30°, 45°, 60°, 75°, 90° or 110°, preferably about 30°, 45° or 60°, and most preferably about 30° or 45°.

It is preferable that the locking mechanism of the inventive device does not engage until and unless the base portion 3 is moved from the retracted position into a fully extended position. For example, and with reference to FIGS. 5-7, the hinged support members 14*a*, 14*b* are moved from their retracted position, through a position in which they are parallel with one another, and into a locking position, the locking position being exemplified in FIGS. 5 and 7.

Figure 26A:
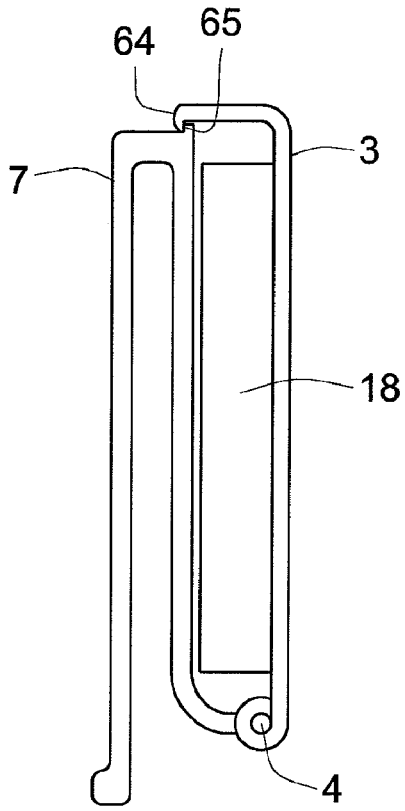
FIG. 26*a* is a side view of a twenty-first embodiment of the device contemplated by the present invention wherein the support is in a fully retracted position.

The precise structure of the hinge 4 of the support is not critical to the device. For example, a common metal or plastic hinge may be incorporated into the support or, if the device is at least partially constructed of a thermoplastic material, the hinge portion may comprise a relatively thin, flexible, portion of the support. In the embodiments shown in FIGS. 5-7, 14, 16 and 17, for example, the hinge is located at what may be conveniently referred to as the upper end of the device, so that the support swings upwardly into a locking position for use, and then downwardly when not in use. In contrast, FIGS. 26*a* and 27*b* are exemplary of a device in which the hinge is located at what may be referred to as the lower end of the device, so that the support swings downwardly into a locking position for use, and then upwardly when not in use. When the hinge 4 is located at the lower end of the device, it is desirable for the angle θ to range from about 90° to about 180°, and preferably be either about 90° or about 180°.

Figure 14:
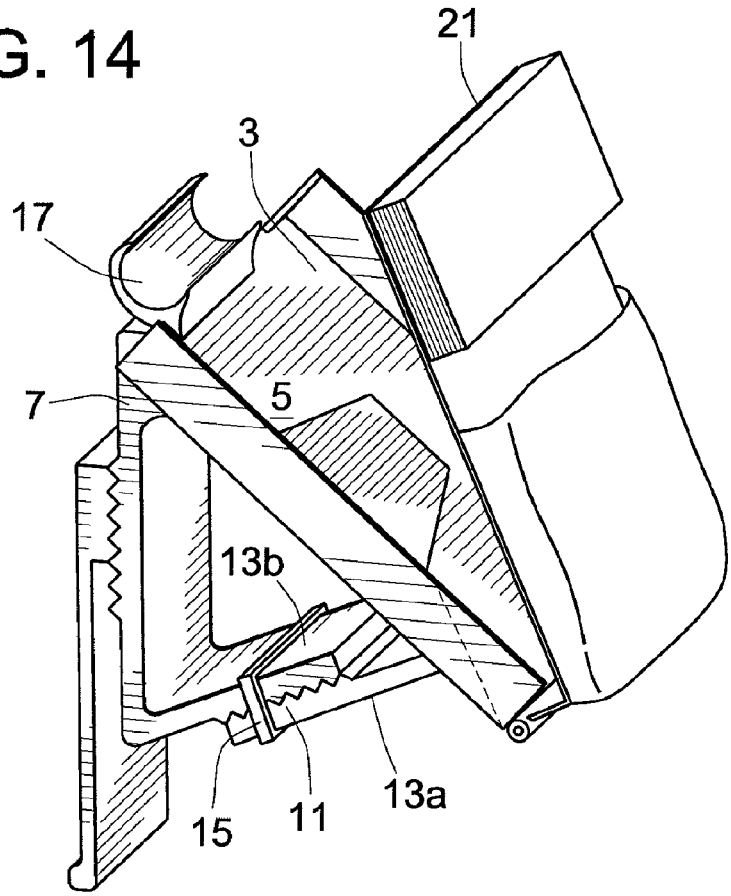
FIG. 14 is a perspective view of a tenth embodiment of the device contemplated by the present invention.

FIG. 14 illustrates yet another example of the locking mechanism portion that may be used in one or more embodiments of the present invention, wherein two interlockable segments 13*a*, 13*b* are provided, with one segment movably attached to the base portion, and a second segment movably attached to the clip portion. In the embodiment depicted in FIG. 14, each segment comprises a plurality of teeth adapted to interlock with one another, which prevents movement of the base and clip portion relative to each other. FIG. 16 illustrates another embodiment, wherein a lock 12 is used in connection with the movable portion of the support, comprising two hinged supports 14*a*, 14*b* which maintain the positions of the base and clip portions at the desired angle θ during use.

The shape of the base portion 3 illustrated in FIGS. 1 and 2, as well as in other illustrated embodiments is desirably a quadrilateral, and comprises a writing surface. While the writing surface alone may be used to record information, the writing surface may also comprise one or more sheets of paper, and preferably comprises a plurality sheets attached to one another by any suitable means, e.g., along one edge by a binding process, ring binding (e.g., FIG. 8, indicia 16), or by adhesive applied to the underside of each sheet, as exemplified by Post-It® notes, available from the 3M Corporation (e.g., FIGS. 8 and 27, indicia 18). The sheets are desirably provided in any suitable size, but will desirably range from about 1-½×2, 2×3, 3×3, 3×4, 4×4, 3×5, 4×6 and 5×8, from about 3 to about 30 square inches, desirably from about 3 to about 16 square inches, and more desirably from about 4 to about 10 square inches. If desired, the base portion may further include at least one, two, three or more edge walls located adjacent the outer end edge of the base portion 13

Figure 8:
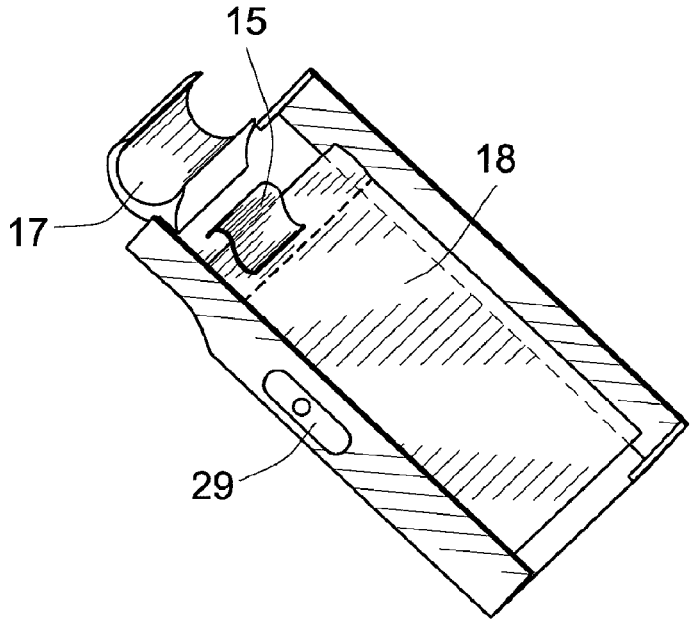
FIG. 8 is a perspective view of a sixth embodiment of the device contemplated by the present invention.
Figure 9:
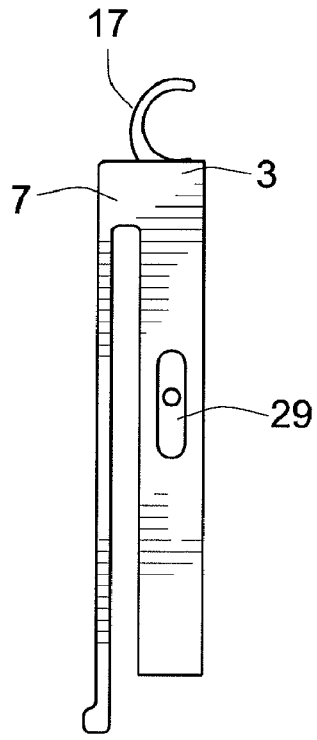
FIG. 9 is a side view of the device depicted in FIG. 9.

(depicted in the embodiment of FIGS. 1 and 2 as dual edge walls 13*a* and 13*b*), which assist in retaining writing material (e.g., paper notepad) on the base portion. The base portion preferably further includes at least one, two, three or more side edge walls located adjacent the outer side edge of the base portion (depicted in this embodiment as dual side walls 13*a* and 13*b*), which also assist in retaining the writing material on the base portion. In lieu of these walls, or in addition thereto, a tab 15 may be included on the base portion (as exemplified in FIG. 8) to assist in retaining the writing material on the base. The tab may be formed from the same material used to form the base (e.g., a resilient plastic), as illustrated in FIG. 8, or may be a material different therefrom (e.g., comprising a metal clip, hinged or unhinged).

The present invention further contemplates the inclusion of one or more optional components in the inventive devices. For example, a holder for a writing implement 17 (e.g., FIGS. 12, 10, 15 and 18-20 may be attached to, or be integral with, the base, preferably as part of a side wall (e.g., FIG. 1), or at the top portion of the device (e.g., FIGS. 3, 4 and 19). The material used to form these holders is desirably a deformable plastic, with the shape of the holder permitting a pencil or other writing device to be snap fit into the holder. Alternatively, the holder may comprise a spring-loaded hinge which can be readily opened to accept the writing implement. A second optional component, depicted in FIGS. 10, 11, 18 and 20) is a calculator 22. The calculator 22 may be located on the device in any convenient location, but is desirably integrated into a base cover (as exemplified in FIGS. 18 and 20) or at the end of the base (e.g., FIG. 10). Other optional components include a pencil sharpener (e.g., FIG. 19, indicia 30), a clock with optional alarm function (e.g., FIG. 20, indicia 25), a digital sound (e.g., voice) recording device and a carpenter's level (e.g., FIG. 8, indicia 29), any or all of which may be attached at any convenient location. Desirably, the clock may be located on the cover, with the level and sharpener located on a base side wall.

A base cover 21 is another optional component, which can serve various functions depending on its design and desired function. The base cover may, as its name implies, cover all (e.g., FIGS. 3, 4, 14, 20) or part (e.g., FIG. 7) of the base, and may further be permanently or removably attached to the base via one or more base side walls (e.g., FIGS. 18, 20), or via a hinge along one edge of the base portion (e.g., FIGS. 3, 4, 7, 13, 14). This cover may be used to provide a second writing surface, and may also serve to protect the writing material from damage, e.g., from water, dirt or the like.

Figure 10:
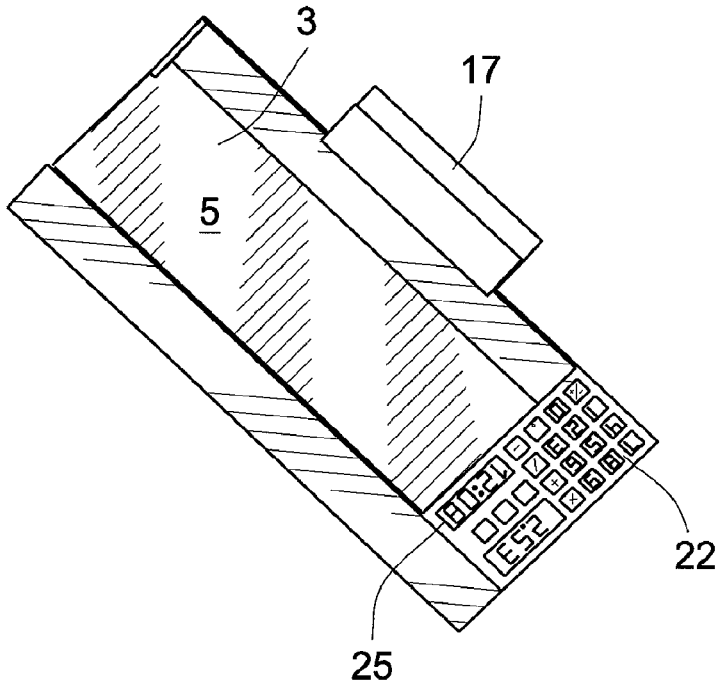
FIG. 10 is a perspective view of a seventh embodiment of the device contemplated by the present invention.
Figure 18:
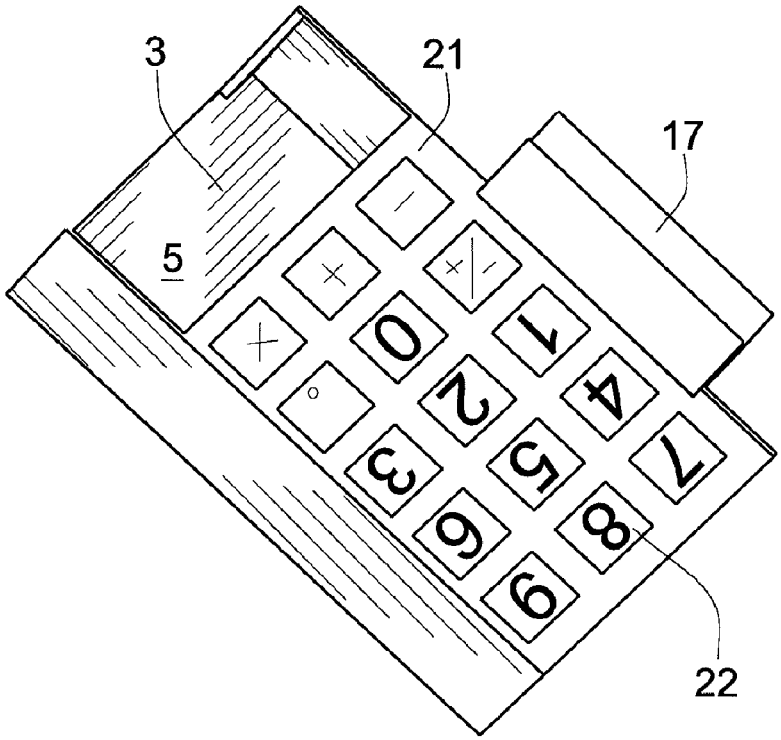
FIG. 18 is a perspective view of a thirteenth embodiment of the device contemplated by the present invention.
Figure 19:
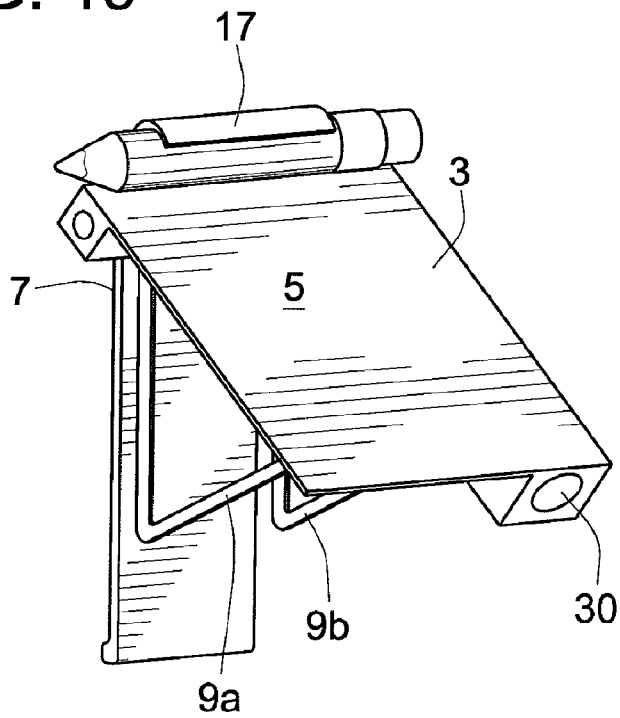
FIG. 19 is a perspective view of a fourteenth embodiment of the device contemplated by the present invention.
Figure 20:
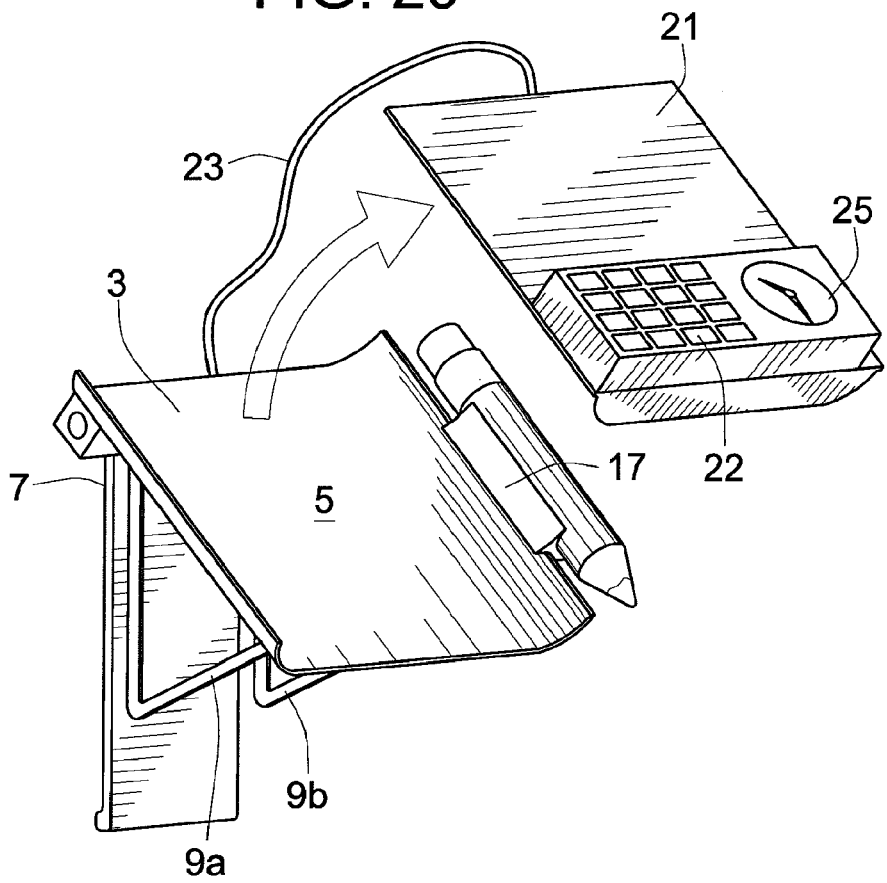
FIG. 20 is a perspective view of a fifteenth embodiment of the device contemplated by the present invention.

The base covers 21 that include optional calculators in FIGS. 10 and 18 cover only part of the base portion, and further include a slot into which notepaper or other writing material may be inserted. The base cover of FIG. 21 forms, with the base portion and three end walls, a slot into which writing material may be inserted. The base cover 21 of FIGS. 20 and 22, in contrast, is removable, permitting ready access to the writing material when needed. While this cover may be separated entirely from the base portion of the device, the cover is preferably attached to the base (or support) by a tether line 23. Any of the embodiments described herein may optionally include a slot into which the notepaper or other writing material may be inserted.

Figure 22:
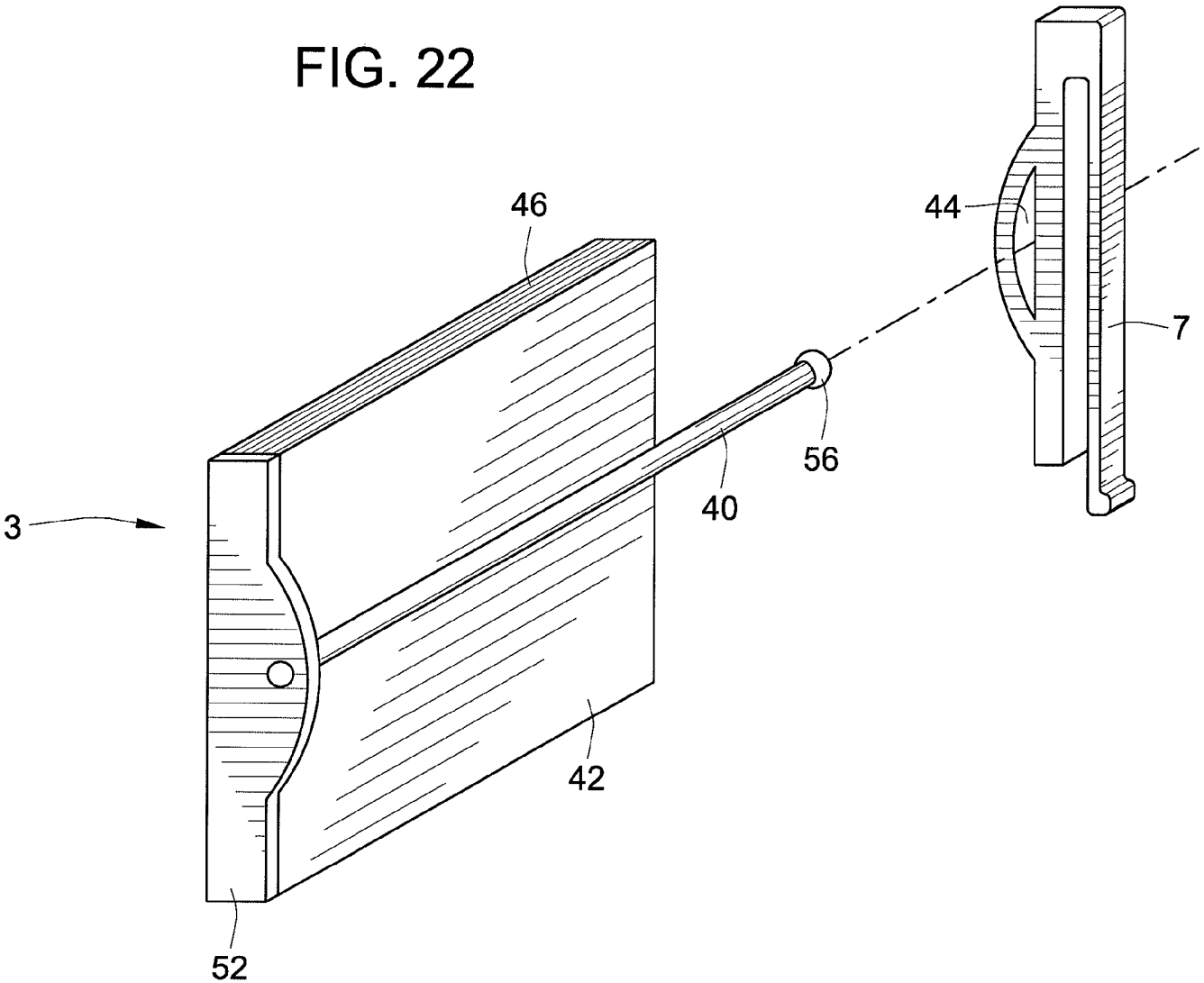
FIG. 22 is a perspective view of a seventeenth embodiment of the device contemplated by the present invention.

In the embodiment of FIG. 22, a tether 31 is provided to permit the base portion 3 to be separated from the clip portion 7. The tether in this embodiment is desirably self-recoiling to permit easy mating of the base and clip portions after use. The mating of the two portions may desirably be provided via a snap-fit connection 33*a*, 33*b*.

Figure 15:
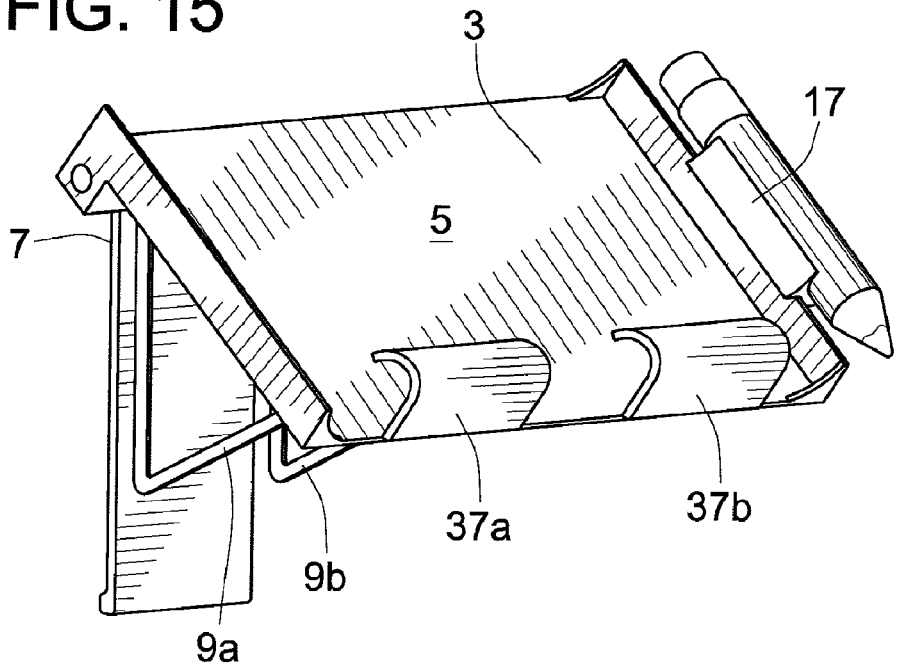
FIG. 15 is a perspective view of a further embodiment of the device contemplated by the present invention.

To further assist in retaining the notepad on the base portion, retaining tabs may be included on the upper surface of the base side walls, as exemplified in FIGS. 1, 2. Alternatively, these tabs may be attached to the base portion, e.g., the writing surface of the base portion. The tabs are illustrated in FIG. 15 as indicia 37*a* and 37*b*, depicted as upwardly and inwardly curving structures.

Figure 3:
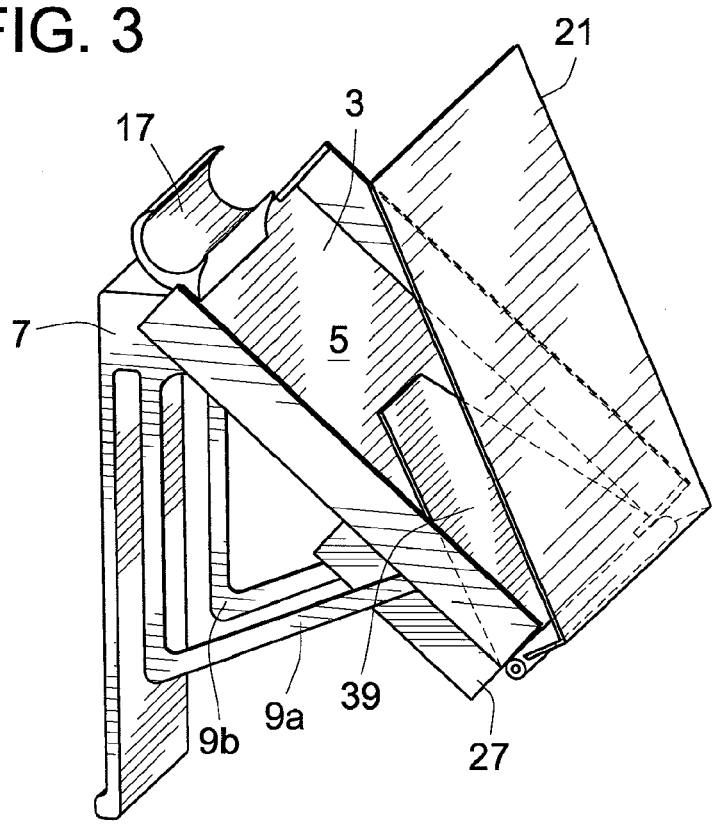
FIG. 3 is a perspective view of a third embodiment of the device contemplated by the present invention.
Figure 4:
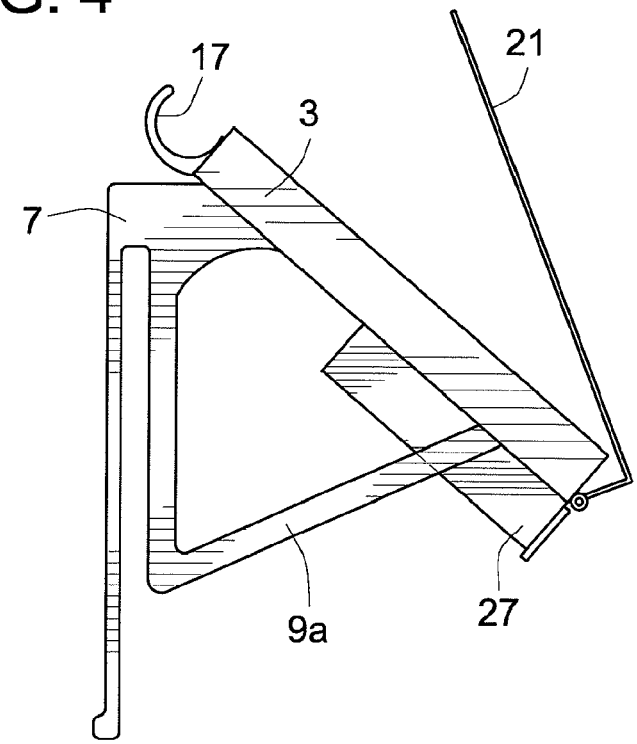
FIG. 4 is a side view of the device depicted in FIG. 3.
Figure 5:
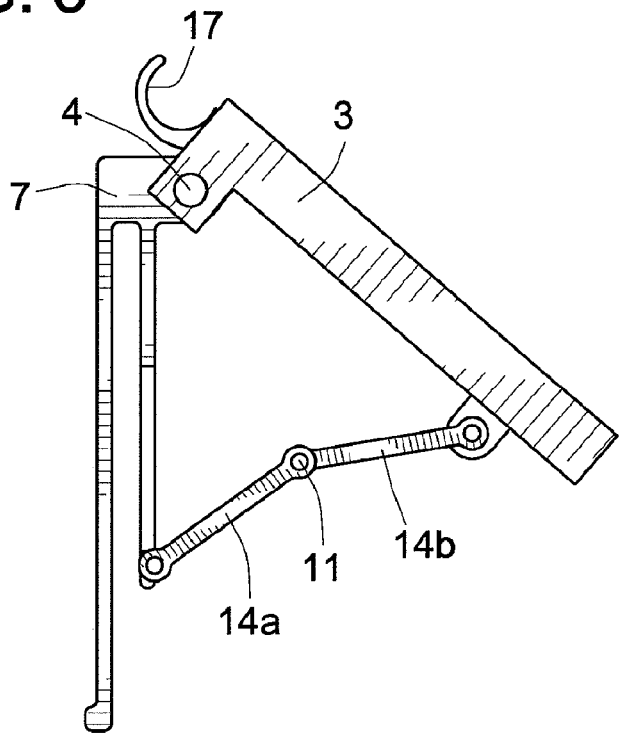
FIG. 5 is a side view of a fourth embodiment of the device contemplated by the present invention wherein a support is depicted in a fully extended position.

Turing to FIG. 3, the base portion 3 may desirably further include a hold down flap 39 which, as its name implies, also assists in holding the notepad onto to the base portion. If present, the notepad backing may be slipped under the hold down flap 39.

FIG. 22 illustrates yet another aspect of the present invention, comprising a base portion 3 and a clip portion 7. The base portion 3 includes a relatively stiff backing material 42 which is attached to a cap 52. The cap 52 in turn assists in retaining notepaper 46 on the base portion during storage and use, and notepaper preferably being clamped thereto via a friction fit or adhered thereto. The cap 52 further includes a bar 40 which may be inserted into a corresponding opening 44 in the clip portion 7. This bar 40, desirably cylindrical in shape and including an enlarged end portion 56 which prevents the bar from inadvertent dislodgement from the clip portion, enables the base to be retained on or removed from the clip portion, as desired.

Figure 23A:
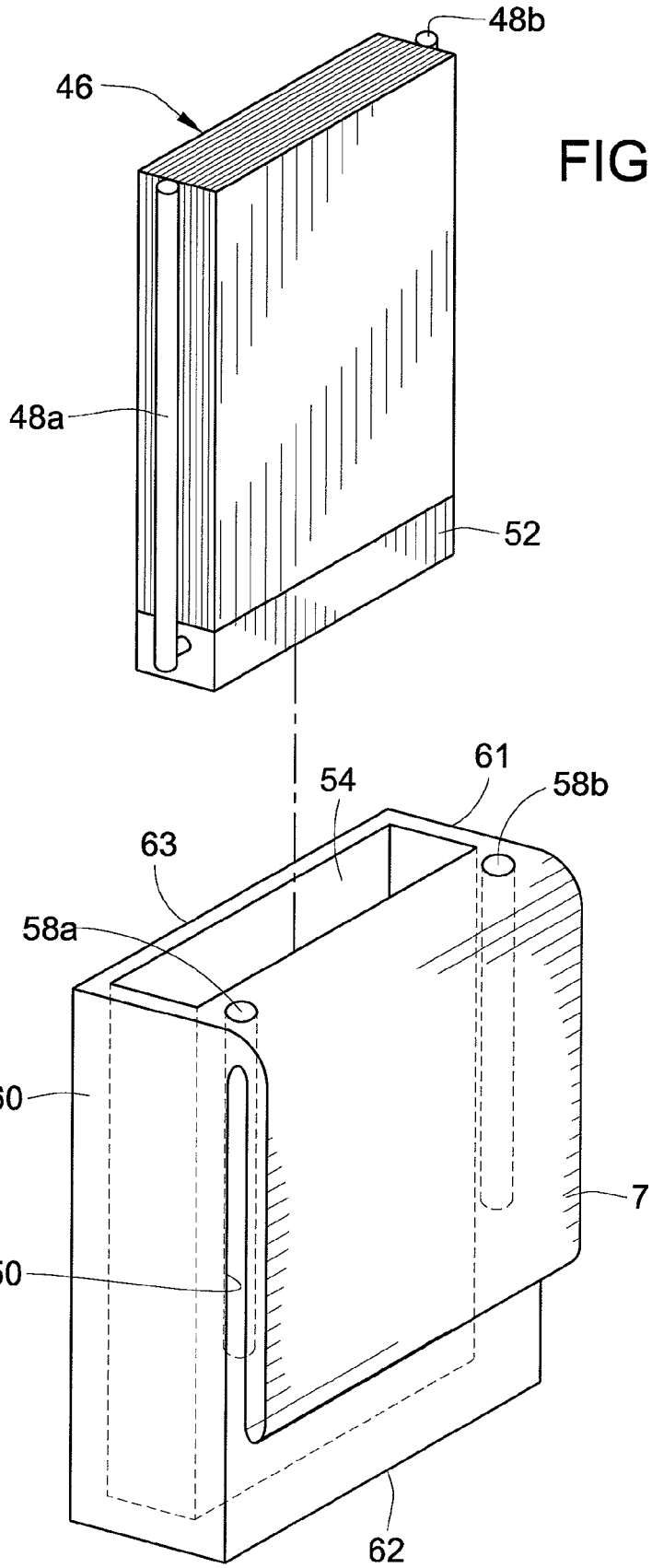
FIGS. 23*a* and 23*b* are perspective views of an eighteenth embodiment of the device contemplated by the present invention.
Figure 23B:
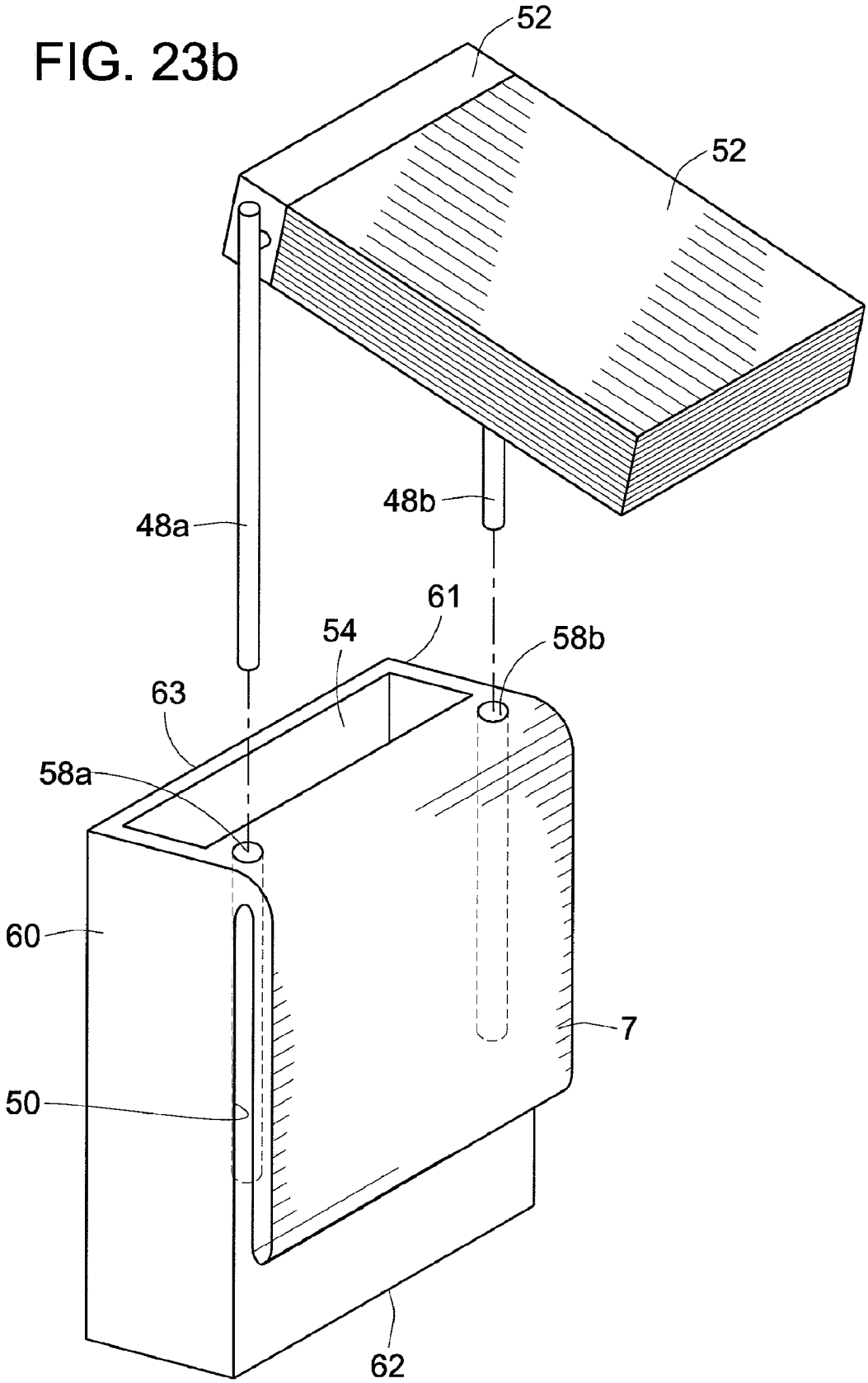

FIGS. 23*a* and 23*b* depict another aspect of the present invention, comprising a combination base 50 and clip 7 portions, with the base further including three side walls 60, 61, 62 and an upper wall 63 which, together with the base 50, define a cavity 54 (shown in phantom) sized to retain notepaper 46 at least substantially therein. The notepaper is desirably attached at one end to a cap 52, the cap having at least two pivotable bars 48*a*, 48*b* appended to the cap 52. Each bar may be inserted into a corresponding opening 58*a*, 58*b* (shown in phantom) in the base portion 50, with the notepaper either being aligned for insertion into the base cavity 54 (as is FIG. 23*a*), or pivoted about the bars 48*a*, 48*b* and aligned so as to be external to the base cavity (as in FIG. 23*b*). In the latter configuration (e.g., FIG. 23*b*), the notepaper may be easily accessed by a user for notetaking, while in the former configuration the notepaper may be suitable for storage (e.g., FIG. 23*a*).

Figure 6:
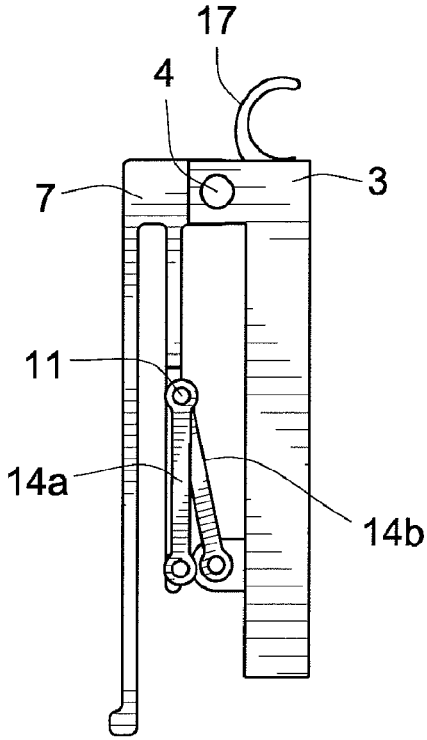
FIG. 6 is a side view of the fourth embodiment of the device shown in FIG. 5 depicting the support in a fully retracted position.
Figure 7:
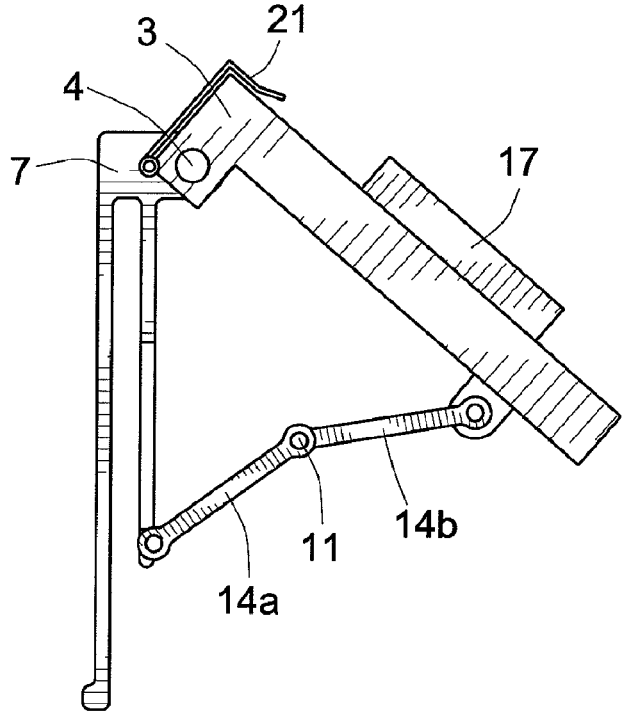
FIG. 7 is a perspective view of a fifth embodiment of the device contemplated by the present invention wherein a support is depicted in a fully extended position.
Figure 24:
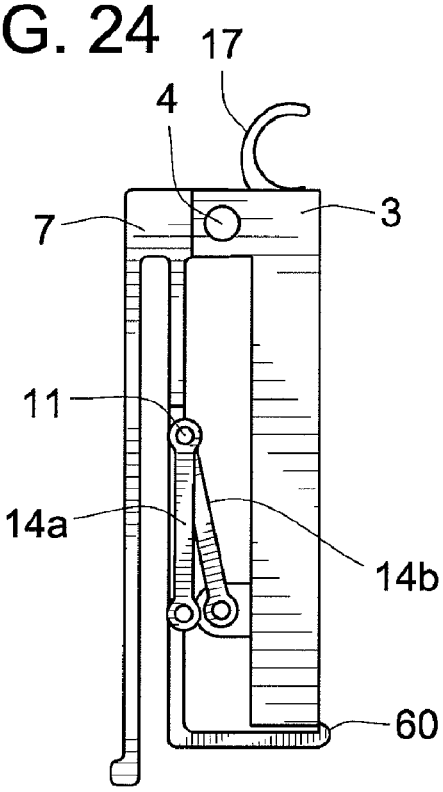
FIG. 24 is a side view of a nineteenth embodiment of the device contemplated by the present invention.
Figure 25:
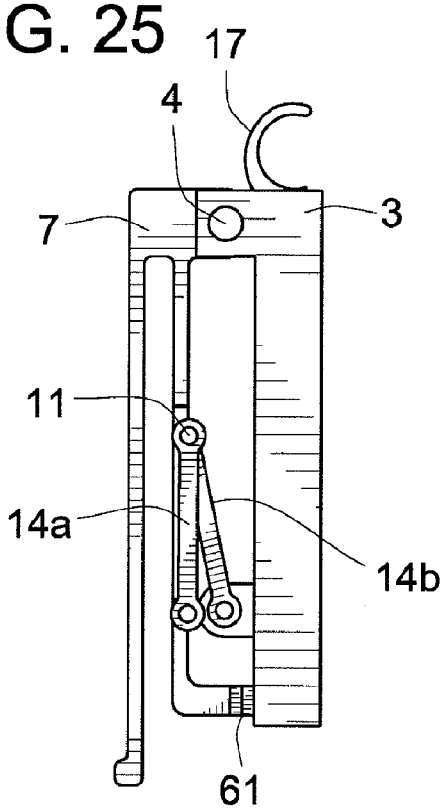
FIG. 25 is a side view of a twentieth embodiment of the device contemplated by the present invention.
Figure 8B:
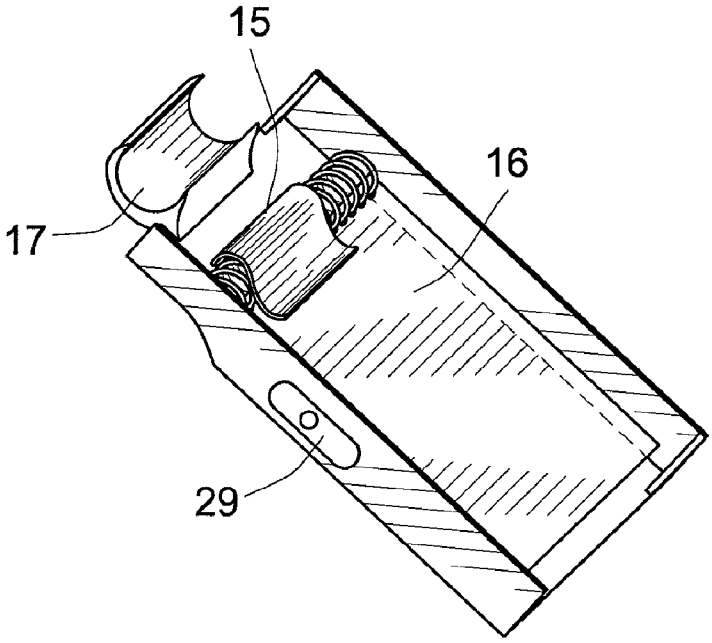

Turning to FIGS. 24 and 25, slightly revised versions of the embodiment depicted in FIG. 6, further includes two alternative base retaining mechanisms, indicia 60 and 61, respectively. These retaining systems are designed to maintain the base in a retracted position when not in use. FIG. 24 illustrates a snap-fit system 60, in which a generally J-shaped hook, protruding from the clip portion 7, engages an edge of the base portion 3, thereby retaining the base in a retracted position. FIG. 25 illustrates the use of two magnets 61, one located on a protrusion from the clip portion, and one located on the base portion, to retain the base portion 3 in a retracted position.

Figure 26B:
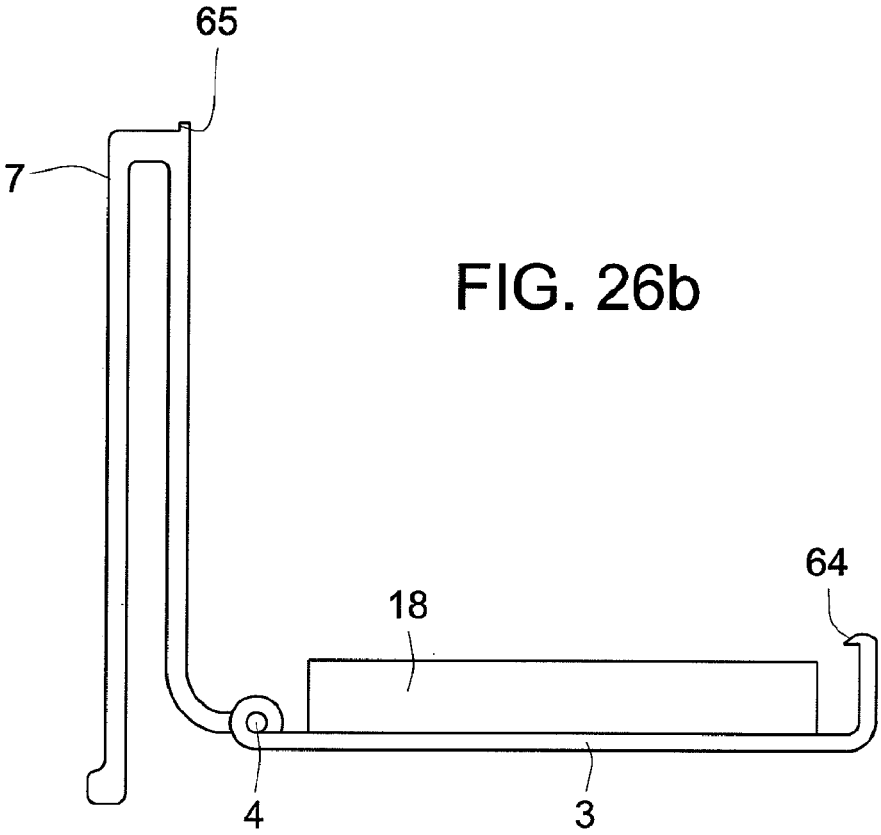
FIG. 26*b* is a side view of the twenty-first embodiment of the device shown in FIG. 26*a* depicting the support in a fully extended position.

FIGS. 26*a* and 26*b* illustrate an embodiment in which the hinge 4 is located generally in the lower portion of the base 3, allowing the writing surface to be revealed by moving the end of the base portion opposite of the hinge downward. This embodiment also includes a base retaining mechanism, in which a generally J-shaped hook 64 protruding from the base 3, engages a corresponding protrusion 65 on the clip portion. Also depicted is a notepad 18 on which notations may be made.

Figure 27:
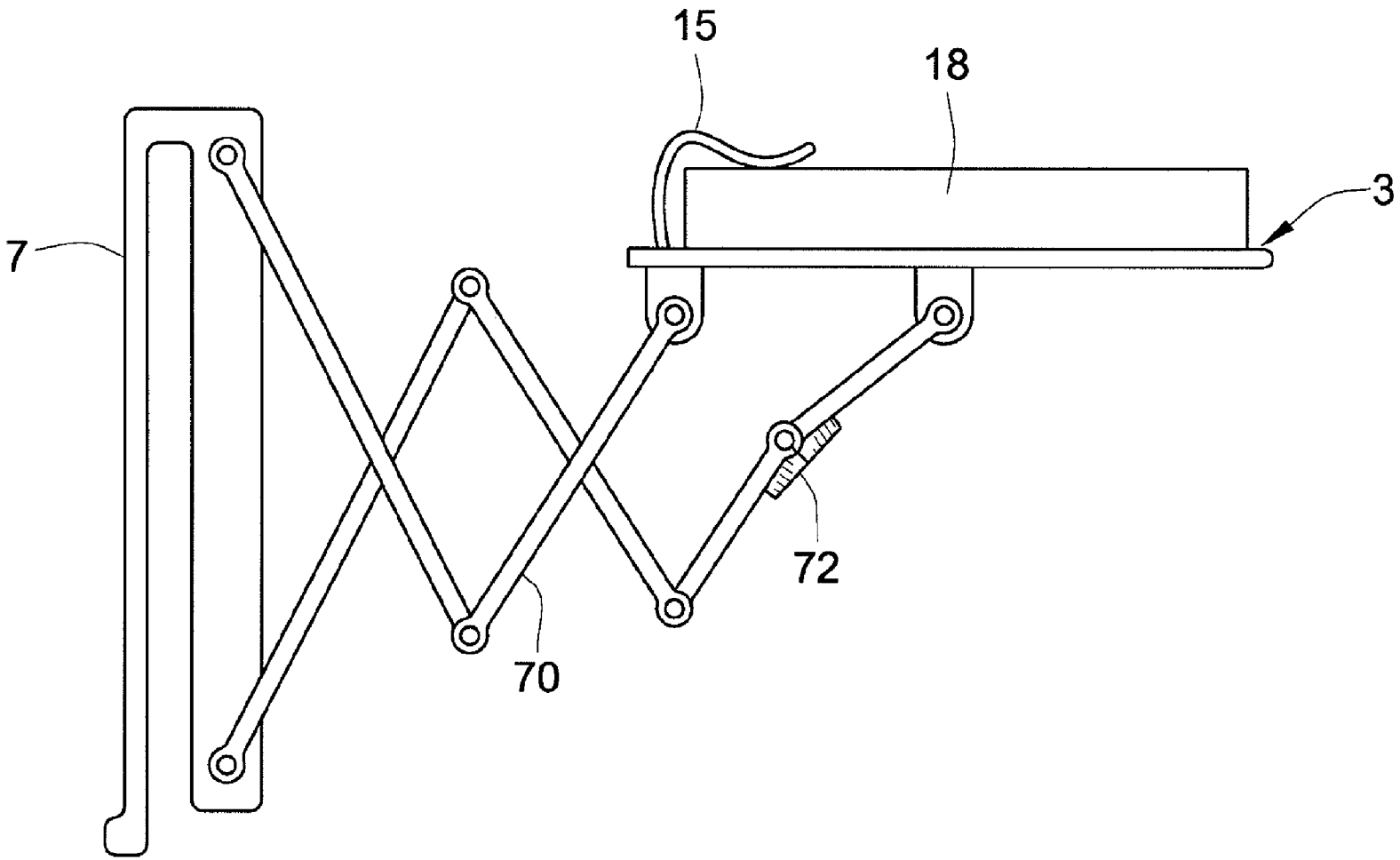
FIG. 27 is a side view of the twenty-second embodiment of the device contemplated by the present invention wherein the support is in a fully extended position.

FIG. 27 illustrates another embodiment which utilizes a scissor hinge 70 to extend the entire base portion 3 outward from the clip portion 7. The hinge 70 may be locked in place when fully extended by locking device 72. A tab 15 is provided to assist in holding the notepaper 18 on the base 3.

The parts of the device, such as the base, clip and support, may be prepared from thermoplastic resins using injection molding. Alternatively, if increased stiffness in any part is desired, thermosetting resins or metal may be used. The materials, techniques and processes used in molding thermoplastic and thermosetting resins are well-known and, therefore, will not be discussed herein.

For simplicity in explanation, the descriptions of the present invention set forth herein refer to a feature in connection with one figure or embodiment of the present invention. Unless explicitly or implicitly excluded, the features described herein in connection with one embodiment may be used in connection the other embodiments described herein.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A device for recording notations comprising:

a base comprising first and second outer edges and which comprises a substantially planar writing surface on an inner portion of the base, a U-shaped clip comprising an open end and a closed end for attaching the device onto a substrate, a hinge having first and second portions, and a base retaining mechanism, wherein a first portion of the hinge is attached on an outer surface of the clip in a lower portion thereof and the second portion of the hinge is attached to the first outer edge of the base permitting the base to be pivoted about the hinge and relative to the clip upward into a closed position and downward into an open position, wherein an angle between the base and clip is about 0° when the base is in the closed position, wherein the writing surface may be written upon only when the base is in the open position, and wherein the base is secured in the closed position by the base retaining mechanism.

2. The device according to claim 1, wherein a first portion of the hinge is attached to the clip adjacent the open end of the clip.

3. The device according to claim 2, wherein the base is a quadrilateral having four outer edges, and wherein the hinge permits the angle between the base and clip to vary between about 0° and about 110° as the base is moved from the closed to the open position.

4. The device according to claim 1, wherein the writing surface comprises at least one sheet of paper.

5. The device according to claim 4, wherein the at least one sheet of paper comprises a plurality of self-adhering paper sheets.

6. The device according to claim 5, wherein the writing surface has an area that does not exceed 24 square inches.

7. The device according to claim 4, wherein at least one side of the base comprises a wall portion which extends upwardly from the base to assist in retaining the at least one sheet of paper on the base.

8. The device according to claim 1, wherein the first portion of the hinge is attached adjacent to the open end of the clip.

9. The device according to claim 1, wherein the writing surface permits a dry erase marker ink to be applied thereon and the ink removed with a dry cloth after use.

10. A method for recording information by a person wearing an article of clothing comprising:

providing a device for recording notations comprising: a base comprising first and second outer edges and which comprises a substantially planar writing surface on an inner portion of the base, a U-shaped clip comprising an open end and a closed end for attaching the device onto a substrate, a hinge having first and second portions, and a base retaining mechanism, wherein a first portion of the hinge is attached on an outer surface of the clip in a lower portion thereof and the second portion of the hinge is attached to the first outer edge of the base permitting the base to be pivoted about the hinge and relative to the clip upward into a closed position and downward into an open position, wherein an angle between the base and clip is about 0° when the base is in the closed position, wherein the writing surface may be written upon only when the base is in the open position, and wherein the base is secured in the closed position by the base retaining mechanism;

securing the device onto the article of clothing, and pivoting the base relative to the clip until the base is in the open position, and recording information on the writing surface.

11. The method according to claim 10, wherein the securing step includes securing the clip onto the article of clothing via friction.

12. The method according to claim 10, wherein the angle between the base and clip varies between about 0° and about 110° as the base is pivoting from the closed position into the open position.

* * * * *